US012281415B2

(12) United States Patent
Ford

(10) Patent No.: US 12,281,415 B2
(45) Date of Patent: Apr. 22, 2025

(54) BATTERY POWERED LEVEL WIND SYSTEM FOR SPINNING AND PROCESSING FIBER FOR YARN

(71) Applicant: Richard Ford, Brasleton, GA (US)

(72) Inventor: Richard Ford, Brasleton, GA (US)

( * ) Notice: Subject to any disclaimer, the term of this patent is extended or adjusted under 35 U.S.C. 154(b) by 567 days.

(21) Appl. No.: 17/078,340

(22) Filed: Oct. 23, 2020

(65) Prior Publication Data

US 2021/0123165 A1 Apr. 29, 2021

Related U.S. Application Data

(60) Provisional application No. 62/973,772, filed on Oct. 24, 2019.

(51) Int. Cl.
*D01H 1/04* (2006.01)
*D01H 1/244* (2006.01)
*D01H 9/04* (2006.01)

(52) U.S. Cl.
CPC ..... *D01H 1/04* (2013.01); *D01H 1/244* (2013.01); *D01H 9/046* (2013.01)

(58) Field of Classification Search
CPC ..... D01H 1/04; D01H 1/244; D01H 1/164; D01H 1/365; D01H 9/046; D01H 9/16; D01H 7/36; D01H 7/24; D01H 7/46; D01H 7/50; D01H 3/00
See application file for complete search history.

(56) References Cited

U.S. PATENT DOCUMENTS 481,787 A * 8/1892 Dawes ..... B65H 54/2896 57/71
661,019 A * 10/1900 McConnan ..... D01H 1/04 242/472.6
705,331 A * 7/1902 Emery ..... B65H 54/2896 242/484.1
2,143,203 A * 1/1939 Maxham ..... D01H 1/00 57/58.7
2,623,347 A * 12/1952 Alfonso ..... D01H 1/00 57/70
3,848,405 A * 11/1974 Karlson ..... B65H 54/02 242/472.6
4,458,474 A * 7/1984 Lee ..... D01H 3/00 57/71
4,617,497 A * 10/1986 Wolf ..... D01H 1/32 318/78

(Continued)

*Primary Examiner* — Uyen T Nguyen
(74) *Attorney, Agent, or Firm* — Bryan W. Bockhop; Bockhop Intellectual Property Law, LLC

(57) ABSTRACT

A flyer for spinning a fibrous roving onto a bobbin includes a housing defines a central hole passing therethrough. A center rod, supporting the bobbin, is rotated by a spinning system. A battery is contained in the flyer and powers an electric motor. A hollow level wind frame is affixed to the housing and defines an elongated slot passing therethrough. A level wind gear in the level wind frame is rotated by the electric motor. A level wind carriage system is driven by the level wind gear and oscillates repeatedly between a first end and a second end as the level wind gear is rotated, and includes a pawl engaged with the level wind gear. A guide is coupled to the pawl and passes through the elongated slot defined by the level wind frame. The fibrous roving passes through the guide.

6 Claims, 3 Drawing Sheets

(56) References Cited

U.S. PATENT DOCUMENTS

| | | | | |
|---|---|---|---|---|
| 6,286,778 | B1 * | 9/2001 | Kudrus | B65H 54/2881 242/486.6 |
| 7,434,820 | B1 * | 10/2008 | Aliseo | B62B 3/104 211/85.5 |
| 2005/0082409 | A1 * | 4/2005 | Jundt | B65H 54/106 242/390.8 |
| 2016/0153125 | A1 * | 6/2016 | Takashima | D01H 1/04 57/315 |
| 2018/0002852 | A1 * | 1/2018 | Yamazaki | D05B 23/00 |

* cited by examiner

BATTERY POWERED LEVEL WIND SYSTEM FOR SPINNING AND PROCESSING FIBER FOR YARN

CROSS-REFERENCE TO RELATED APPLICATION(S)

This application claims the benefit of U.S. Provisional Patent Application Ser. No. 62/973,772, filed Oct. 24, 2019, the entirety of which is hereby incorporated herein by reference.

BACKGROUND OF THE INVENTION

1. Field of the Invention

The present invention relates to fibrous roving spinning systems and, more specifically, to a spinning flyer having a level wind system.

2. Description of the Related Art

A typical spinning system for making yarn and the like employs a flyer to spin fibrous roving in a single (a single strand in yarn) and then wind the single onto a bobbin. Traditional spinning systems employ a series of hooks disposed along one arm of the flyer to guide the roving onto the bobbin. As one portion of the bobbin is filled up, the user moves the roving from one hook to an adjacent hook to start filling an adjacent portion of the bobbin. Some spinning systems employ a moveable guide that the user moves along the arm to distribute the roving on the bobbin. Both of these types of systems require the user to stop spinning either to change hooks or to move the guide.

One system employs a mechanical level wind gear that automatically moves the guide during the spinning operation. However, this system requires a complex set of gears, including a special type of geared bobbin, to operate. It cannot be used with a conventional bobbin and the special bobbins tend to be more expensive than conventional bobbins.

Existing level wind systems for arts and craft applications were mechanically geared or belt driven with the need for special bobbins and equipment, making such devices costly due to custom components required.

Therefore, there is a need for a flyer that has a level wind system that automatically moves the guide during spinning, but that can be used with conventional bobbins.

SUMMARY OF THE INVENTION

The disadvantages of the prior art are overcome by the present invention which, in one aspect, is a flyer for spinning a fibrous roving onto a bobbin and configured for use with a spinning system. A housing defines a central hole passing therethrough. A center rod passes through the housing and is rotated by the spinning system. The center rod supports the bobbin and defines a passage that opens to a center hole that is in alignment with the central hole of the housing so that the fibrous roving passes into the center rod through the passage and out through the central hole of the housing. An electric motor is affixed to the housing. A battery is contained in the flyer and powers the electric motor. A hollow level wind frame is affixed to the housing and parallel to the center rod. The hollow level wind frame defines an elongated slot passing therethrough. A level wind gear is disposed in the level wind frame and is rotated by the electric motor. A level wind carriage system is driven by the level wind gear so as to oscillate repeatedly between a first end and a second end as the level wind gear is rotated. The level wind carriage system includes a pawl that is engaged with the level wind gear and a guide that is coupled to the pawl. The guide passes through the elongated slot defined by the level wind frame. The fibrous roving passes through the guide.

In another aspect, the invention is a spinning flyer for spinning a fibrous roving onto a bobbin and configured for use with a spinning system. A housing defines a central hole passing therethrough. A center rod passes through the housing and is rotated by the spinning system. The center rod supports the bobbin. The center rod defines a passage that opens to a center hole that is in alignment with the central hole of the housing so that the fibrous roving passes into the center rod through the passage and out through the central hole of the housing. An electric motor is affixed to the housing. A battery is contained in the flyer and powers the electric motor. The battery is electrically coupled to the electric motor via a switch. A hollow level wind frame is affixed to the housing and is parallel to the center rod. The hollow level wind frame defines an elongated slot passing therethrough. A level wind gear is disposed in the level wind frame and is rotated by the electric motor. A level wind carriage system is driven by the level wind gear so as to oscillate repeatedly between a first end and a second end as the level wind gear is rotated. A pawl is engaged with the level wind gear. A guide is coupled to the pawl and passes through the elongated slot defined by the level wind frame. Fibrous roving passes through the guide. A balance rod is affixed to an opposite side of the housing from the hollow level wind frame and the batteries are disposed in the balance rod. A drive pulley is affixed to the housing and receives rotational force from the spinning system. The drive pulley rotates the housing and the level wind frame about the center rod.

In yet another aspect, the invention is a system for use in spinning a fibrous roving that includes a frame. An electric motor is coupled to the frame. A battery is attached to the frame and is configured to power the electric motor. An elongated bi-directional level wind gear has a first end and an opposite second end. The level wind gear is supported by the frame and is rotated by the electric motor. A level wind carriage system is driven by the level wind gear so as to oscillate repeatedly between the first end and the second end as the level wind gear is rotated. The level wind carriage system includes a pawl that is engaged with the level wind gear and a guide that is coupled to the pawl and that is affixed to the pawl. The fibrous roving passes through the guide.

These and other aspects of the invention will become apparent from the following description of the preferred embodiments taken in conjunction with the following drawings. As would be obvious to one skilled in the art, many variations and modifications of the invention may be effected without departing from the spirit and scope of the novel concepts of the disclosure.

DETAILED DESCRIPTION OF THE INVENTION

Figure 1A:
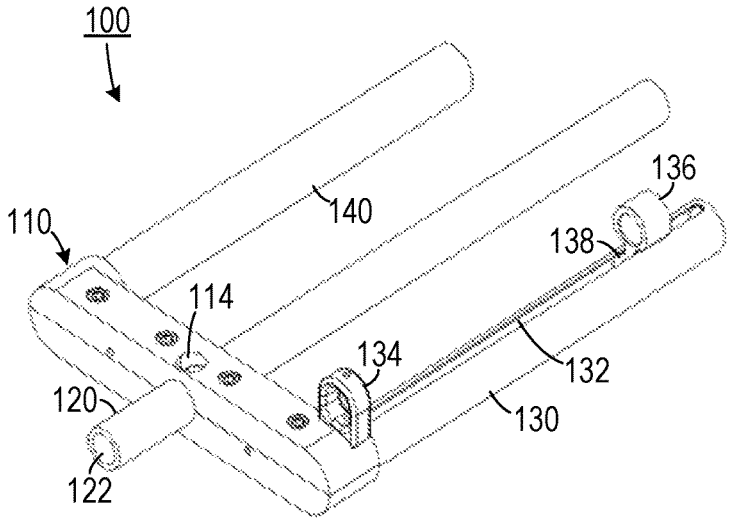
FIG. 1A is a perspective view of one embodiment of a flyer for spinning a fibrous roving.
Figure 1B:
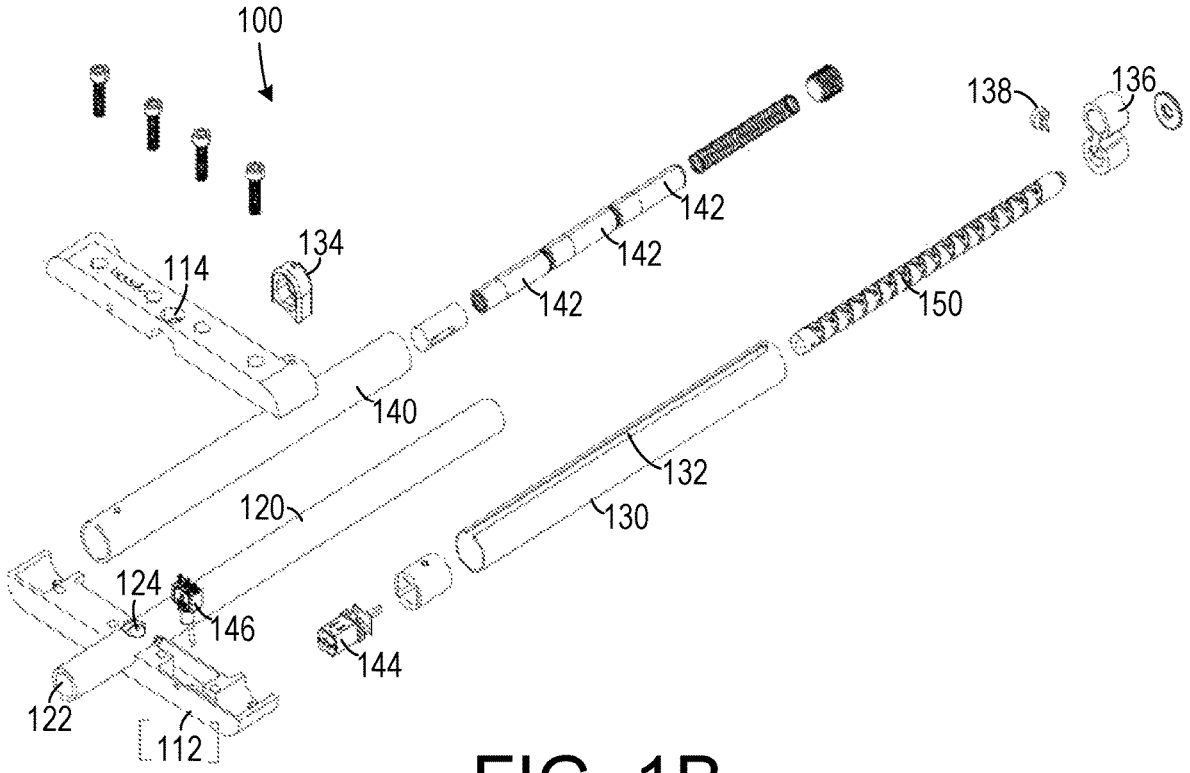
FIG. 1B is an exploded view of the embodiment show in FIG. 1A.
Figure 2A:
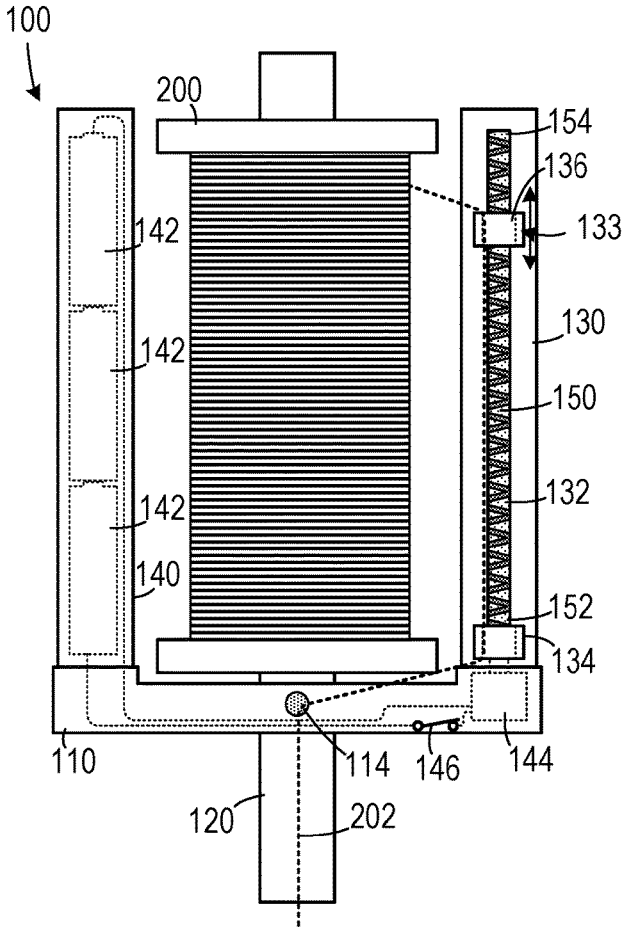
FIG. 2A is a schematic plan view of the embodiment shown in FIG. 1A.
Figure 2B:
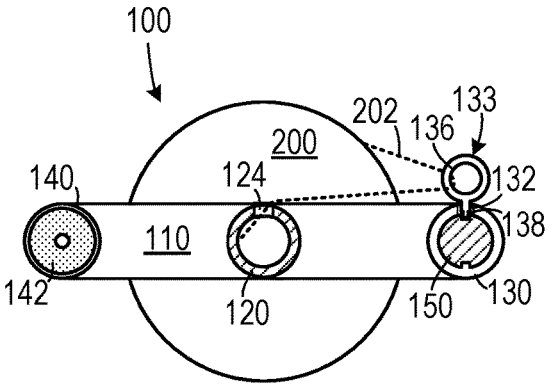
FIG. 2B is a schematic end elevational view of the embodiment show in FIG. 1A.
Figure 3:
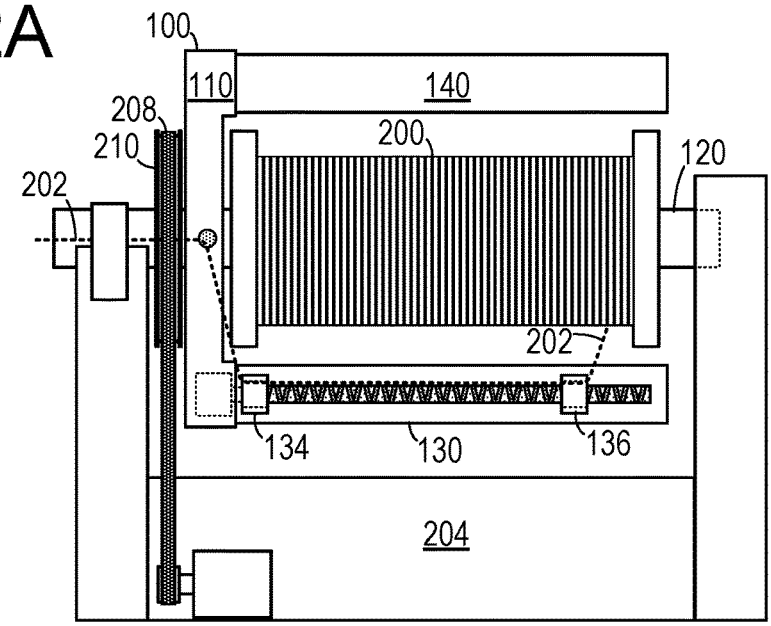
FIG. 3 is an elevational view of the embodiment show in FIG. 1A coupled to a spinning system.

A preferred embodiment of the invention is now described in detail. Referring to the drawings, like numbers indicate like parts throughout the views. Unless otherwise specifically indicated in the disclosure that follows, the drawings are not necessarily drawn to scale. The present disclosure should in no way be limited to the exemplary implementations and techniques illustrated in the drawings and described below. As used in the description herein and throughout the claims, the following terms take the meanings explicitly associated herein, unless the context clearly dictates otherwise: the meaning of "a," "an," and "the" includes plural reference, the meaning of "in" includes "in" and "on."

As shown in FIGS. 1A, 1B, 2A, 2B and 3, one embodiment of a flyer 100 for spinning a fibrous roving 202 onto a bobbin 200 can be used with a conventional spinning system 204. The flyer 100 has a housing 110 that defines a central hole 114 passing therethrough. A center rod 120, which supports the bobbin 200, passes through the housing 110 and is rotated by the spinning system 204. The center rod 120 defines a passage 122 that opens to a center hole 124 that is in alignment with the central hole 114 of the housing 110 so that the fibrous roving 202 passes into the center rod 120 through the passage 122 and out through the central hole 114 of the housing 110.

An electric motor 144, such as a D.C. electric motor, is affixed to the housing 110 and a battery 142 (which can include a plurality of cells) via a switch 146 that selectively electrically couples the battery 142 to the electric motor 144. The battery 142 is contained in the flyer 110 and powers the electric motor 144. A balance rod 140 is affixed to an opposite side of the housing 110 from the hollow level wind frame 130. The batteries 142 may be disposed in the balance rod 140.

A hollow level wind frame 130 is affixed to the housing 100 so as to be parallel to the center rod 120. The hollow level wind frame 130 defines an elongated slot 132 passing therethrough. A level wind gear 150 (i.e., a bi-directional worm gear) is disposed in the level wind frame 130 and is rotated by the electric motor 144. The housing 110 can be made of such materials as a machined metal, such as aluminum, or a plastic. The center rod 120, the balance rod 140 and the hollow level wind frame 130 can be made, for example, of aluminum tubing.

A level wind carriage system 133 is driven by the level wind gear 150 so as to oscillate repeatedly between the first end 152 and the second end 154 as the level wind gear 150 is rotated. The level wind carriage system 133 includes a pawl 138 that is engaged with the level wind gear 150 and a guide 136 that is coupled to the pawl 138. The guide 136 passes through the elongated slot 132 and is affixed to the pawl 138.

For use with certain types of spinning systems (such as those referred to as "Scotch tension spinners," "Irish tension spinners" and "double drive spinners), a drive pulley 210 is affixed to the housing 110 and receives rotational force from a belt 208 coupled to the spinning system. The drive pulley 210 rotates the housing 110 and the level wind frame 130 about the center rod 120.

Figure 4A:
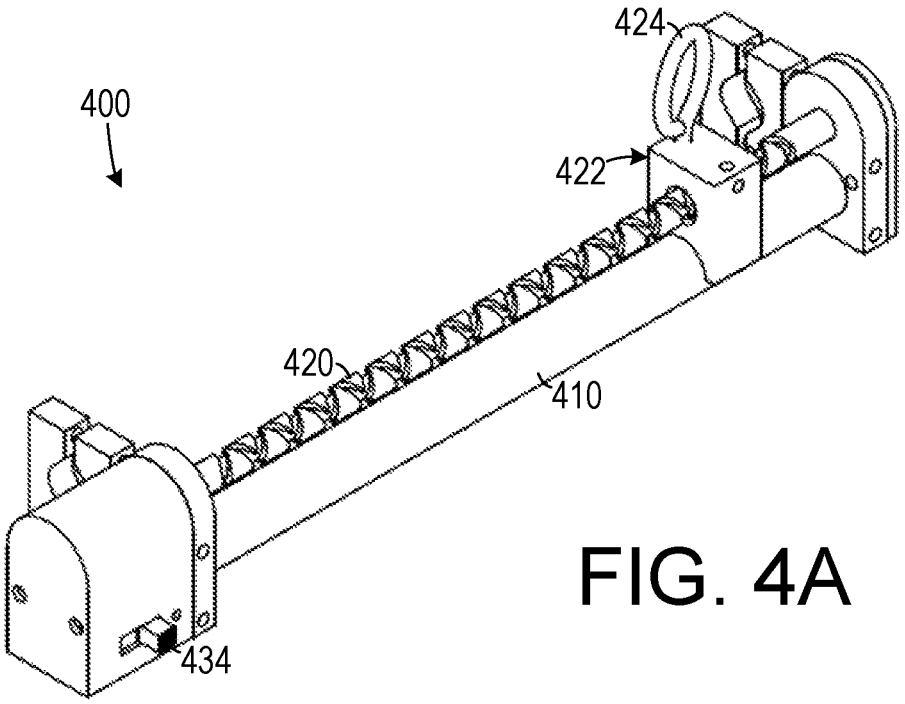
FIG. 4A is a perspective view of one embodiment of a level wind system.
Figure 4B:
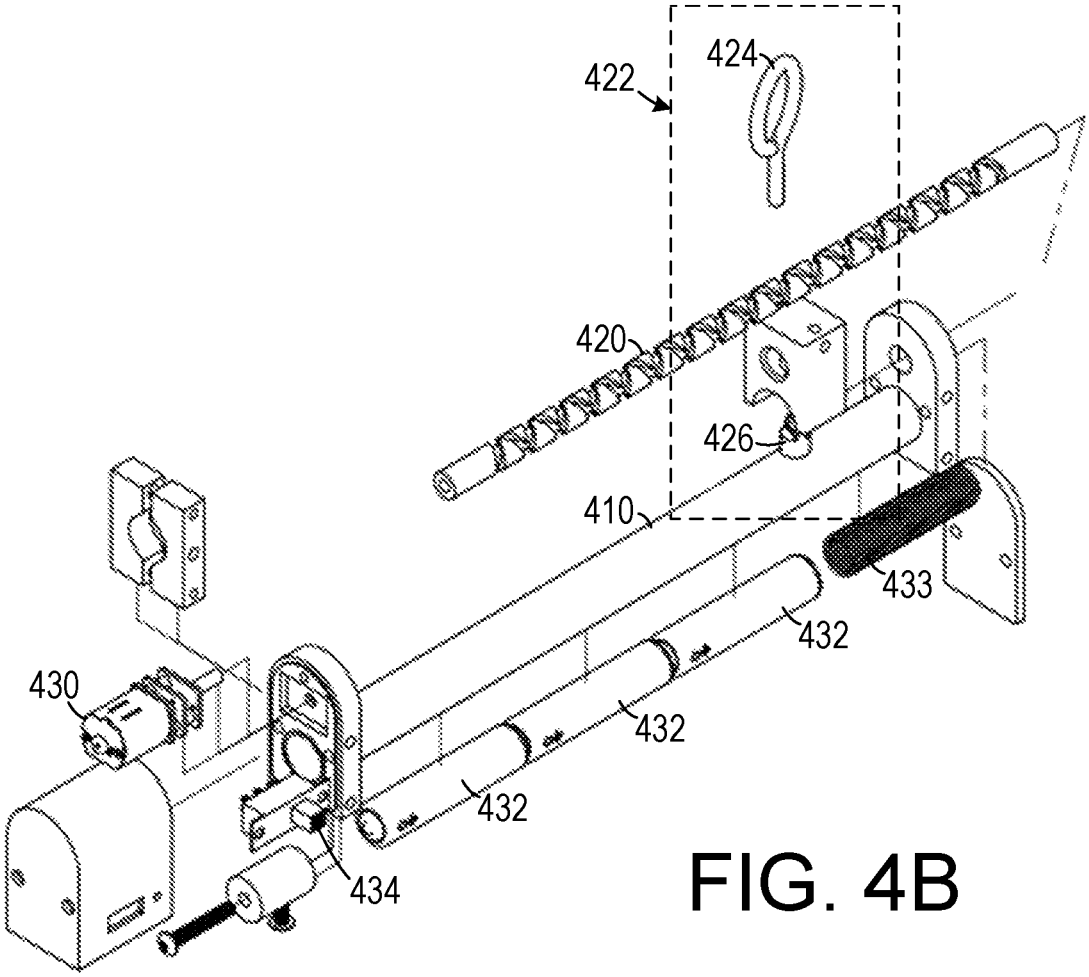
FIG. 4B is an exploded view of the embodiment show in FIG. 4A.

As shown in FIGS. 4A and 4B, a level wind system 400 can be used for use in distributing various types of fibrous materials, such as a fibrous roving used in a spinning system. Such a system 400 includes a frame 410 and an electric motor 430 that is coupled to the frame 410 and that is controlled by a switch 434. A battery 432 is attached to the frame 410 powers the electric motor 430. An elongated bi-directional level wind gear 420 is supported by the frame 410 and is rotated by the electric motor 430. A level wind carriage system 422 is driven by the level wind gear 420 so as to oscillate repeatedly between the first end and the second end as the level wind gear 420 is rotated. The level wind carriage system 422 includes a pawl 426 that is engaged with the level wind gear 420 and a guide 424 that is coupled to the pawl 426.

The battery powered level wind system of the present invention allows fiber processors to evenly distribute twisted fiber onto any bobbin, shaft or core without the need of manually or mechanically powering the system. The battery powered level wind system enables one to evenly distribute and level wind fiber, string or cable onto any bobbin, shaft or core. The battery powered level winder does not require special bobbins or other components to operate. It is a simple device that can be added to any machine to enable one to level wind. The battery powered level wind system is not brand or manufacturer specific and can be adapted for many uses. Spinning wheels, electric powered spinning wheels, bobbin winders or skein winders.

To operate one embodiment of the system, the following steps can be executed:

1. mount the level wind system to any machine desired;
2. feed fiber string or cord thought the feed loop;
3. turn on the level wind system (which can be done with a manual switch or through an auto-start configuration in some embodiments);
4. start spinning or processing the materiel.

When the worm screw turns it will then move the level wind carriage back a forth along the frame assembly tube. The material passing though the Feed Loop of the guide will be distributed onto a spinning bobbin, shaft or core—resulting in an even distribution of material to save space for more material to be processed easily later.

Although specific advantages have been enumerated above, various embodiments may include some, none, or all of the enumerated advantages. Other technical advantages may become readily apparent to one of ordinary skill in the art after review of the following figures and description. It is understood that, although exemplary embodiments are illustrated in the figures and described below, the principles of the present disclosure may be implemented using any number of techniques, whether currently known or not. Modifications, additions, or omissions may be made to the systems, apparatuses, and methods described herein without departing from the scope of the invention. The components of the systems and apparatuses may be integrated or separated. The operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set. It is intended that the claims and claim elements recited below do not invoke 35 U.S.C. § 112(f) unless the words "means for" or "step for" are explicitly used in the particular claim. The above described embodiments, while including the preferred embodiment and the best mode of the invention known to the inventor at the time of filing, are given as illustrative examples only. It will be readily appreciated that many deviations may be made from the specific embodiments disclosed in this specification without departing from the spirit and scope of the invention. Accordingly, the scope of the invention is to be determined by the claims below rather than being limited to the specifically described embodiments above.

What is claimed is:

1. A flyer for spinning a fibrous roving onto a bobbin and configured for use with a spinning system, comprising:

(a) a housing defining a central hole passing therethrough;

(b) a center rod that passes through the housing and that is configured to be rotated by the spinning system, the center rod supporting the bobbin, the center rod defining a passage that opens to a center hole that is in alignment with the central hole of the housing so that the fibrous roving passes into the center rod through the passage and out through the central hole of the housing;

(c) a balance rod extending from a first end of the housing parallel to the center rod, at least one battery disposed inside of the balance rod; and (d) a level wind carriage system including:

(i) a hollow level wind frame extending from a second end of the housing, opposite from the first end, that is parallel to the center rod, the hollow level wind frame defining an elongated slot passing therethrough, (ii) an electric motor disposed within the hollow level wind frame adjacent to the housing, the electric motor powered by the at least one battery;

(iii) a bi-directional worm gear that is disposed inside the hollow level wind frame, the bi-directional worm gear in alignment with the electric motor and coupled directly thereto so as to be rotated directly by the electric motor;

(iv) a pawl that is engaged with the bi-directional worm gear so as to oscillate between a first end of the bi-directional worm gear and an opposite second end of the bi-directional worm gear repeatedly as the bi-directional worm gear is rotated by the electric motor; and (v) a guide that is coupled to the pawl and that passes through the elongated slot defined by the level wind frame, through which the fibrous roving passes to the bobbin.

2. The flyer of claim 1, further comprising a switch that is affixed to the flyer and that selectively electrically couples the at least one battery to the electric motor.

3. The flyer of claim 1, further comprising a drive pulley affixed to the housing that is configured to receive rotational force from the spinning system and that rotates the housing and the level wind frame about the center rod.

4. A spinning flyer for spinning a fibrous roving onto a bobbin and configured for use with a spinning system, comprising:

a housing defining a central hole passing therethrough;

a center rod that passes through the housing and that is configured to be rotated by the spinning system, the center rod supporting the bobbin, the center rod defining a passage that opens to a center hole that is in alignment with the central hole of the housing so that the fibrous roving passes into the center rod through the passage and out through the central hole of the housing;

(c) a balance rod extending from a first end of the housing parallel to the center rod, at least one battery disposed inside of the balance rod;

(d) a level wind carriage system including:

(i) a hollow level wind frame extending from a second end of the housing, opposite from the first end, that is parallel to the center rod, the hollow level wind frame defining an elongated slot passing therethrough, (ii) an electric motor disposed within the hollow level wind frame adjacent to the housing, the electric motor powered by the at least one battery;

(iii) a bi-directional worm gear that is disposed inside the hollow level wind frame, the bi-directional worm gear in alignment with the electric motor and coupled directly thereto so as to be rotated directly by the electric motor;

(iv) a pawl that is engaged with the bi-directional worm gear so as to oscillate between a first end of the bi-directional worm gear and an opposite second end of the bi-directional worm gear repeatedly as the bi-directional worm gear is rotated by the electric motor; and (v) a guide that is coupled to the pawl and that passes through the elongated slot defined by the level wind frame, through which the fibrous roving passes to the bobbin; and (e) a drive pulley affixed to the housing that is configured to receive rotational force from the spinning system and that rotates the housing and the level wind frame about the center rod.

5. A system for use in spinning a fibrous roving, comprising:

a frame;

a hollow level wind frame extending from the main frame, the hollow level wind frame defining an elongated slot passing therethrough;

an electric motor disposed within the hollow level wind frame and coupled to the main frame;

a battery attached to the main frame and configured to power the electric motor;

an elongated bi-directional worm gear, having a first end and an opposite second end, that is supported by the main frame and that is rotated by the electric motor, wherein the electric motor is directly coupled to the bi-directional worm gear and is aligned with the bi-directional worm gear so that the electric motor drives the bi-directional worm gear directly; and a level wind carriage system driven by the bi-directional worm gear so as to oscillate repeatedly between the first end and the second end as the bi-directional worm gear is rotated, and including:

(i) a pawl that is engaged with the bi-directional worm gear; and (ii) a guide that is coupled to the pawl and passes through the elongated slot defined by the level wind frame, through which the fibrous roving passes, wherein the battery is disposed in a balance rod that is attached to the main frame opposite from the level wind carriage system.

6. The system of claim 5, employed in a flyer for spinning a fibrous roving onto a bobbin and configured for use with a spinning system.

* * * * *